United States Patent [19]

Burnham et al.

[11] 4,203,365

[45] May 20, 1980

[54] JAMMER APPREHENDING AMPLIFIER FOR PROXIMITY FUZES

[75] Inventors: Bradshaw Burnham, Rochester, N.Y.; Charles F. Nichols, Webster, N.Y.

[73] Assignee: The United States of America as represented by the Secretary of the Navy, Washington, D.C.

[21] Appl. No.: 611,084

[22] Filed: Sep. 20, 1956

[51] Int. Cl.[2] ..... F42C 13/04

[52] U.S. Cl. ..... 102/214; 343/7 PF

[58] Field of Search ..... 343/7, 12, 13.1, 7 PF; 102/70.2 P, 214

[56] References Cited

U.S. PATENT DOCUMENTS

| | | | |
|---|---|---|---|
| 2,259,982 | 10/1941 | Alexanderson | 343/12 |
| 2,494,339 | 1/1950 | Keister | 343/5 |
| 2,760,188 | 8/1956 | Guanella | 102/70.2 P |
| 3,614,781 | 10/1971 | Lichtman | 343/7 PF |
| 3,732,564 | 5/1973 | Kuck et al. | 343/7 PF |
| 3,821,737 | 6/1974 | Kalmus | 343/7 PF |
| 3,877,377 | 4/1975 | Rabinow | 343/7 PF X |
| 4,021,803 | 5/1977 | Richmond et al. | 343/7 PF |

FOREIGN PATENT DOCUMENTS

| | | | |
|---|---|---|---|
| 864811 | 5/1941 | France | 102/70.2 P |

*Primary Examiner*—T. H. Tubbesing

*Attorney, Agent, or Firm*—R. S. Sciascia; A. L. Branning

EXEMPLARY CLAIM

1. In a device for exploding a vehicle in proximity to a target, a proximity control circuit comprising a source of electromagnetic energy, means connected to said source for radiating said energy into space and for intercepting electromagnetic energy therefrom, including any portion of said radiated energy reflected from a target, first circuit means connected to said source and being selectively responsive to said reflected energy for generating an initiating signal, normally ineffective electroresponsive means connected to said last named means for actuating a firing mechanism upon being rendered effective by said initiating signal, and second circuit means connected to said source and to said electroresponsive means being selectively responsive to intercepted energy other than said reflected energy for maintaining said electroresponsive means ineffective until a predetermined time after interception of said other energy.

9 Claims, 2 Drawing Figures

JAMMER APPREHENDING AMPLIFIER FOR PROXIMITY FUZES

This invention relates generally to a proximity fuze for an ordnance projectile or the like, and more particularly to a proximity fuze having jammer resistance circuits incorporated therein.

Although jammer signal resistance circuits for proximity fuzes have been heretofore devised and utilized, the majority of these jammer resistance circuits have been designed to be rendered operative only upon the reception of jammer signals having a square-wave characteristic. Other circuits have been designed to utilize a beat note generated by the interaction of a sweeping jammer signal and the fuze oscillator frequency to energize an amplifier circuit for producing a signal to temporarily desensitize the proximity fuze. Although the heretofore devised jammer resistance circuits have been found to operate satisfactorily for the purposes intended, they have not operated entirely satisfactorily when exposed to jamming signals having characteristics similar to the echo signals reflected from a suitable target to which the proximity fuze is normally responsive. Additionally, the heretofore devised jammer resistance circuits have not operated entirely satisfactorily in response to jammer signals having characteristics different from those for which the circuit was specifically designed.

Accordingly, one object of the present invention is to provide a new and improved jammer resistant circuit for a proximity fuze having the versatility to discriminate against jammer signals of more than one type.

Another object of the present invention is to provide a new and improved jammer resistant circuit for proximity fuzes, or the like, having the ability to discriminate against jammer signals exhibiting the characteristics of target echo signals.

A further object of the present invention is to provide a new and improved jammer signal apprehending amplifier circuit for use with proximity fuzes.

A still further object of the present invention is to provide a new and improved jammer discriminating proximity fuze for an ordnance projectile which is less susceptible to premature detonation or dudding than those heretofore devised.

Figure 1:
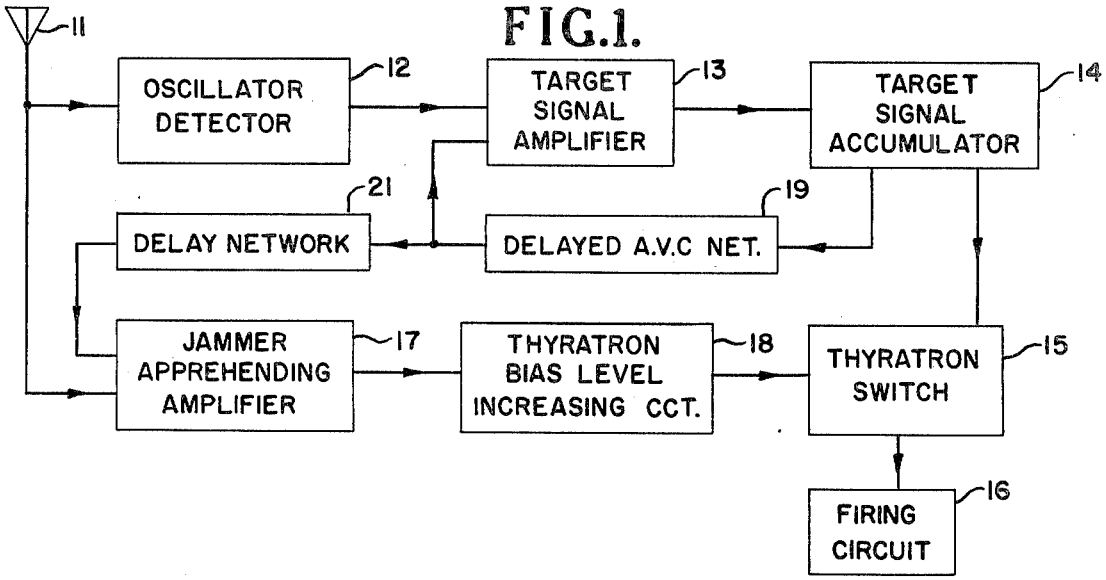
Figure 2:
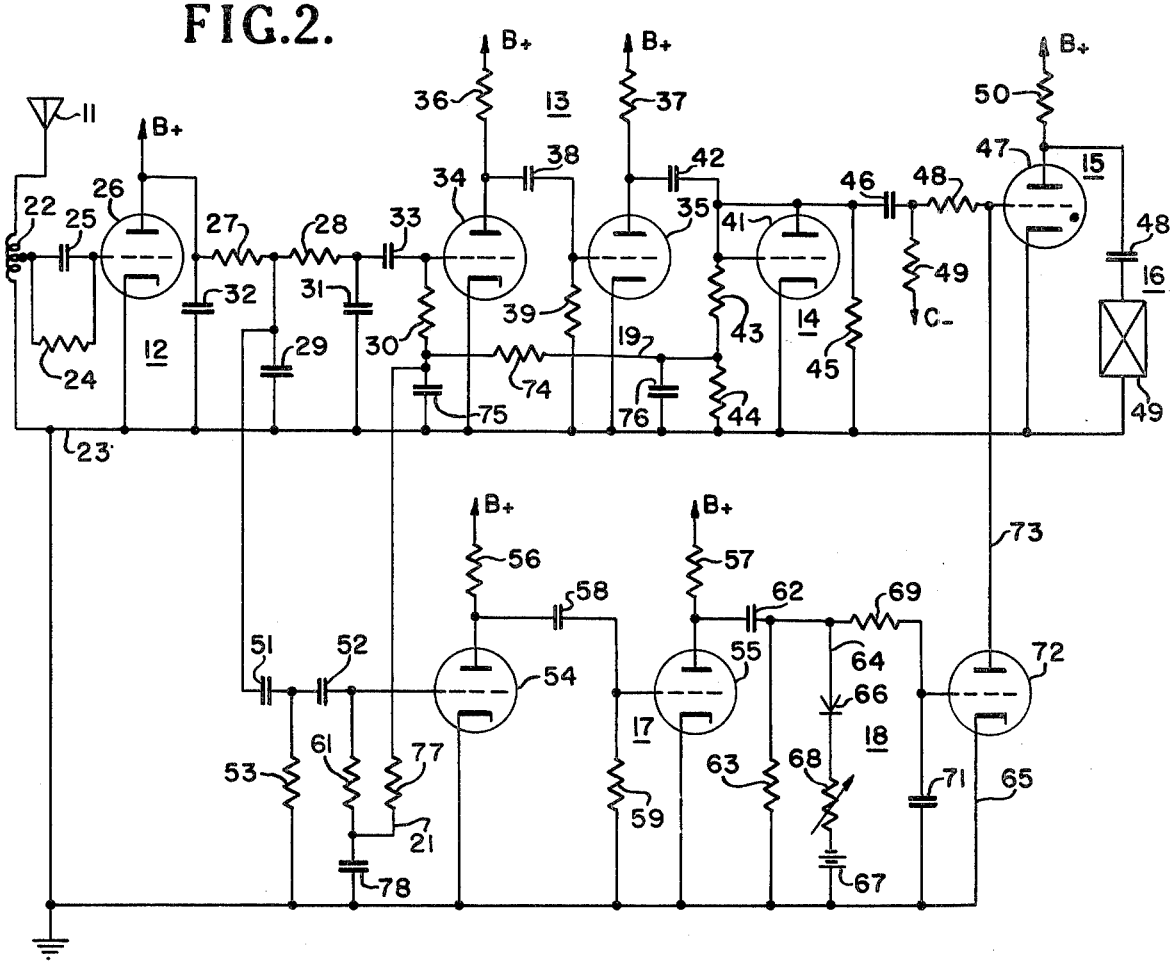

Other objects and many of the attendant advantages of this invention will be readily appreciated as the same becomes better understood by reference to the following detailed description when considered in connection with the accompanying drawings wherein:

FIG. 1 is a block diagrammatic view broadly indicating the arrangement of the improved jammer discriminating proximity fuze according to the present invention; and FIG. 2 is a schematic diagram illustrating in detail the novel circuit arrangement of the jammer discriminating proximity fuze according to the present invention.

Referring now to the drawing wherein like reference numerals indicate like parts throughout the several views and more particularly to FIG. 1 whereon is shown an overall block diagrammatic arrangement of the jammer resistant proximity fuze. As shown thereon, the proximity fuze includes an antenna 11 for transmitting a high frequency signal generated by the oscillator portion of the oscillator-detector circuit 12 into space and for receiving any target reflected, or other high frequency signal in the immediate surrounding area.

Upon the reception of a suitable target reflected signal by antenna 11, the received signal is fed into the oscillator-detector circuit 12 wherein it is combined with the oscillator generated frequency signal to produce a heterodyne, or beat, frequency output signal. The beat frequency output signal is fed into a target signal amplifier 13 which has a selective signal response characteristic such that an output firing signal is produced only upon a beat signal of a predetermined frequency which is indicative of target proximity. To insure target proximity within the lethal range of the ordnance projectile, a target signal accumulator circuit or integrating circuit 14 is interposed between the amplifier 13 and thyratron switch 15 whereby ignition of the switch 15 is delayed for a predetermined number of cycles of the firing signal output of amplifier 13. Upon ignition of the thyratron switch 15, a firing circuit 16 is actuated for detonating the projectile and destroying the target.

Paralleling the target signal channel consisting of amplifier 13 and the target signal accumulator 14 is a jammer signal channel consisting of jammer apprehending amplifier 17, having an input signal frequency band pass response in a frequency range slightly above the band pass frequency response range of the target signal amplifier 13, and a thyratron bias level increasing circuit 18. Additionally a delayed AVC network 19 is provided for the target signal amplifier 13 and the jammer signal apprehending amplifier 17 for reducing the gain of the amplifiers 13 and 17 in response to a signal above a predetermined threshold amplitude. An additional delay network 21 is provided for making the compression delay of the amplifier 17 slightly longer than that of the target amplifier 13.

If, instead of a target signal, a jammer signal is intercepted by the fuze antenna 11, the following jammer discriminator operation occurs in the proximity fuze. Inasmuch as a modulated CW or pulsed jammer signal inherently contains high order harmonic frequencies, the intercepted jammer signal will be more readily amplified by the jammer apprehending amplifier 17 than by the target signal amplifier 13 due to the respective band pass response characteristics thereof. The output of amplifier 17 is fed into the thyratron bias level increasing circuit 18 wherein the intercepted and amplified jammer signal is converted into a suitable d.c. signal, as will hereinafter be more fully explained, for effecting an increase in the thyratron biasing signal thereby maintaining the thyratron switch 15 ineffective and rendering the firing circuit 16 non-responsive to the intercepted jamming signal. If, on the otherhand, a signal from a sweeping type jammer is intercepted by the antenna 11 which results in the generation of a beat signal by the oscillator-detector 12 within the band pass range of the target signal amplifier 13, the integrating or storage characteristics of the accumulator circuit 14 will prevent operation of the thyratron switch 15 for the reason that the transient nature of the frequency signal from a sweep jammer will be of insufficient duration for effecting ignition of the thyratron switch 15. Additionally, if a pulse jammer signal having a low frequency amplitude variation similar to that of a target echo is received, although the target signal channel will be responsive to the simulated target echo signal and produce a firing signal, the jammer signal channel will produce a control signal in response to the harmonic content of the jammer pulse which will prevent the firing signal from rendering the thyratron switch 15 conductive.

Although each of the componential circuits of the inventive jammer resistant proximity fuze may be of conventional designs well known to those versed in the art, and consequently have been shown in block diagrammatic form and described therewith, a preferred specific circuit arrangement is shown in FIG. 2 of the drawing by way of illustration and not limitation. As shown thereon the fuze antenna 11 has a coupling coil 22 connected between it and a common lead 23, the coil with its associated shunting capacities also serving as a tank circuit for the oscillator-detector circuit 12. The circuit 12 is illustrated by a Hartley oscillator and a regenerative detector circuit having a self-biasing network consisting of the parallel combination of resistor 24 and condenser 25 interposed between the coil 22 and the grid of the electron tube 26, which tube is connected between a suitable operating potential source B+ and common lead 23. The detected output signal of the oscillator-detector circuit 12 is connected to the target amplifier circuit 13 through a frequency selective coupling network consisting of resistors 27, 28 and shunting condensers 29, 31, plate load impedance 32, coupling condenser 33 and grid resistor 30. The amplifier 13 consists of two coupled stages and includes electron tubes 34, 35 connected across the common lead 23 and a suitable operating potential source B+ through resistors 36 and 37 respectively. Coupling is provided between the two stages by means of condenser 38 and resistor 39. The amplified output of amplifier 13 is fed to the target signal accumulator circuit 14 consisting of a three element electron tube 41 connected as a diode in an integrating circuit consisting of a coupling network, including condenser 42 and resistors 43 and 44, and output circuit including resistor 45 and blocking condenser 46. The firing signal accumulating on tube 41 is fed to the grid of the normally cut-off thyratron tube 47 of the thyratron switch circuit 15 through decoupling resistor 48. The tube 47 is normally biased below cut-off by means of a source of suitable biasing potential C− connected to the tube grid through current limiting resistor 49. Tube 47 is connected across the common lead 23 and a source of suitable operating potential B+ through resistor 50 connected to the anode thereof. Connected across the gas discharge tube 47 is the fuze firing circuit 16 consisting of charged condenser 48 and electroresponsive primer, or detonator, 49, said firing circuit being adapted to be fired upon the conduction of tube 15 upon the receipt of a firing signal of a predetermined amplitude from accumulator circuit 14. The operation of a substantial portion of the aforedescribed circuit is given in an article entitled "Proximity Fuzes for Artillery" by Homer Selvidge appearing on pages 104 to 109 of the February 1946 issue of Electronics Magazine.

The output signal from the oscillator-detector circuit 12 is also coupled to the jammer apprehending amplifier 17 through a selective input network consisting of condensers 51, 52 and resistor 53, the circuit being responsive to signals of a frequency higher than that of the target signal amplifier frequency selective network. The jammer apprehending amplifier 17 consists of two stages of amplification and includes vacuum tubes 54, 55, connected across the common connection 23 and a suitable operating potential source B+ through resistors 56 and 57 respectively. The stages are interconnected by a coupling network including condenser 58 and resistor 59. Resistor 61 functions as a grid leak for tube 54. The amplified output signal of tube 55 is fed through a coupling network consisting of condenser 62 and resistor 63 to the thyratron bias level increasing circuit 18 which includes a clipper circuit 64 and a clamping circuit 65. The clipper circuit includes a crystal, or vacuum, diode 66 whose level of operation is regulated by C battery 67 and rheostat 68. The unidirectional output of the clipper circuit 64 is coupled through resistor 69 and condenser 71 to a triode clamp tube 72 the plate of which is connected through lead 73 to the grid of the gas tube 47. It may readily be seen that tube 72 when conducting increases the bias on tube 47 by simulating a low resistance in the grid circuit thereof and thereby renders the firing circuit 16 insensitive to jamming signals intercepted by the fuze antenna 11.

The delayed AVC network 19 includes dropping resistor 74 and shunting condensers 75 and 76 and feeds back a control voltage to the grids of tubes 34 and 54 proportional to the voltage developed across resistor 44, thereby controlling the gain thereof. The simultaneous application of the AVC signal to the target signal amplifier 13 and to the jammer apprehending amplifier 17 is provided to effect a parallel relationship between the two channels whereby the proximity fuze is less susceptible to dudding when subjected to a target echo signal with a considerable background of jamming signals. The delay network 21 comprises resistor 77 and condenser 78 which form an R-C timing circuit for prolonging the compression, or AVC action, upon the jammer apprehending amplifier 17 thereby preventing late firing of the proximity fuze by intercepted signals which compressed both channel amplifiers simultaneously and allowed the "clamp" of thyration 47 to be partially removed before the accumulator circuit 14 had become quiescent below the threshold voltage of the thyratron tube 47.

Although the proximity fuze circuit illustrated on FIG. 2 is substantially complete for purposes of clarity and facility of explanation, such components as feed through and h.f. by-pass condensers have not been included in the diagram.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A device for exploding a vehicle in proximity to a target, a proximity control circuit comprising a source of electromagnetic energy, means connected to said source for radiating said energy into space and for intercepting electromagnetic energy therefrom, including any portion of said radiated energy reflected from a target, first circuit means connected to said source and being selectively responsive to said reflected energy for generating an initiating signal, normally ineffective electroresponsive means connected to said last named means for actuating a firing mechanism upon being rendered effective by said initiating signal, and second circuit means connected to said source and to said electroresponsive means being selectively responsive to intercepted energy other than said reflected energy for maintaining said electroresponsive means ineffective until a predetermined time after interception of said other energy.

2. In a fuze for exploding a projectile in proximity to a target, a proximity circuit comprising an oscillator for generating an electromagnetic signal, an antenna coupled to said oscillator for radiating said signal into space and for intercepting electromagnetic signals within the surrounding spatial area, including any portion of said radiated signal reflected from a target, a detector connected to said oscillator for developing a beat frequency signal proportional to the frequency difference between the generated and the intercepted signals, a plurality of signal channel means connected to said detector and being selectively responsive to said beat signal for developing output signals indicative thereof, normally ineffective electroresponsive firing means coupled to one of said channel means and being adapted to be rendered effective by the output signal developed by one of said channel means, and circuit means coupled to another of said channel means and to said firing means for developing a control signal to render said firing means ineffective in response to the output signal developed by another of said channel means.

3. In a fuze for exploding a projectile in proximity to a target, a proximity circuit comprising an oscillator for generating an electromagnetic signal, an antenna coupled to said oscillator for radiating said signal into space and for intercepting electromagnetic signals within the surrounding spatial area, including any portion of said radiated signal reflected from a target, a detector connected to said oscillator for developing a beat frequency signal proportional to the frequency difference between said generated and intercepted signals, first channel means connected to said detector and being selectively responsive to a beat frequency signal indicative of a target reflected signal for producing a firing signal, second channel means connected to said detector and being selectively responsive to a beat frequency signal indicative of signals other than a target reflected signal for developing a control signal, and means connected to said first and second channel means for maintaining said firing signal ineffective for a predetermined time.

4. A proximity circuit according to claim 3 wherein said first channel means includes a frequency selective amplifier circuit for producing an amplified output signal, and an accumulator circuit for developing a firing signal in response to a predetermined number of said output signals.

5. A proximity circuit according to claim 3 wherein said second channel means includes a frequency selective amplifier circuit for producing an amplified output signal, a clipper circuit for converting said output signal into a unidirectional signal, and a clamping circuit for developing a control signal in response to said unidirectional signal.

6. A proximity circuit according to claim 5 wherein said second channel means is adapted to develop a control signal sufficient to overcome the effect of a firing signal developed by said first channel means in response to the interception of a jammer pulse signal having characteristics similar to a target echo signal.

7. A proximity circuit according to claim 6 wherein said first channel means includes a normally nonconducting gas discharge device adapted to be rendered conductive.

8. A proximity circuit according to claim 3 and further including an AVC circuit coupled to said first and said second channel means for simultaneously controlling the gain thereof.

9. A proximity circuit according to claim 8, and further including a delay network connected to said AVC circuit and to said second channel means for prolonging the control of the gain thereof by said AVC circuit.

* * * * *